United States Patent [19]

Koboshi et al.

[11] Patent Number: 4,791,013

[45] Date of Patent: Dec. 13, 1988

[54] HOUSING PACK FOR PHOTOGRAPHIC PROCESSING SOLUTION

[75] Inventors: Shigeharu Koboshi; Kazuhiro Kobayashi; Kazuyoshi Miyaoka; Syozo Aoki; Naoki Takabayashi, all of Hino, Japan

[73] Assignee: Konishiroku Photo Industry Co., Ltd., Tokyo, Japan

[21] Appl. No.: 939,047

[22] Filed: Dec. 8, 1986

[30] Foreign Application Priority Data

| | | | |
|---|---|---|---|
| Dec. 9, 1985 | [JP] | Japan | 60-276513 |
| Dec. 19, 1985 | [JP] | Japan | 60-286390 |
| Dec. 27, 1985 | [JP] | Japan | 60-294856 |

[51] Int. Cl.[4] ..... B65D 1/24; B65D 35/22

[52] U.S. Cl. ..... 428/35.3; 220/22; 220/20.5; 222/94; 215/6; 428/35.4; 428/36.6

[58] Field of Search ..... 428/35; 383/38, 39; 215/6; 222/94; 220/22, 20.5

[56] References Cited

U.S. PATENT DOCUMENTS

| | | | |
|---|---|---|---|
| 4,148,417 | 4/1979 | Simmons | 222/94 |
| 4,496,046 | 1/1985 | Stone et al. | 383/38 |
| 4,548,606 | 10/1985 | Larkin | 222/94 |
| 4,651,874 | 3/1987 | Nakamura | 383/38 |

*Primary Examiner*—John E. Kittle
*Assistant Examiner*—James J. Seidleck
*Attorney, Agent, or Firm*—Jordan B. Birman

[57] ABSTRACT

The present invention provides a container for containing a photographic processing solution which comprises a housing member and a partion member, thereby the container is divided into two chambers of which the first chamber is prepared for containing the photographic processing solution and the second chamber is prepared for collecting the waste solution. One part of the housing member forming the first chamber comprises a oxygen shelter for restraining oxygen permiation therethrough into the first chamber below 20 ml/m$^2$/24 hrs. The second chamber has a solution-absorbing material therein for facilitating the collection of the waste solution.

17 Claims, 4 Drawing Sheets

HOUSING PACK FOR PHOTOGRAPHIC PROCESSING SOLUTION

BACKGROUND OF THE INVENTION

The present invention relates to an improved housing pack for housing a component of photographic processing mixture, and more particularly, to a container for housing the component of photographic processing mixture. The housing pack is durable when it is subjected to an attack of photographic processing solution which is unnecessary to be prepared, and facilitates a handling of a waste solution of the photographic processing solution.

Most of photographic processing solutions, which are used when photographic materials are exposed and developed, have oxidizing and reducing powers and are susceptible to air oxidation.

Sulfites are added to developers and color developing agents as preservatives so that the sulfites may prevent the developers and the color developing agents from being air-oxidized as much as possible. Sulfites are also added to fixing solutions and bleach-fix solution because they are also air-oxidized, with the result that sodium hyposulfite is decomposed to liberate sulfur, which may cause serious accidents. Sulfites are also added to a stabilizing solution for non-water washing treatment to prevent a fungicide from degrading as a result of air oxidation. In spite of the addition of sulfites to the above-described photographic processing solutions, they degrade as a result of air oxidation when they are preserved more than two weeks in a ready-to-use kit container such as bottles and bags conventionally used made of polyethylene film (flexible containers called Scholle pack in trade name). Accordingly, they are supplied with users in the form of a kit separately packed which contains a component of a photographic processing mixture. They are dissolved in a solution by using water just before use so as to exhaust it in a short period of time.

Therefore, photofinishing laboratories are required to prepare a photofinishing solution by dissolving packs one by one, thus causing troublesome works. Users are required to wait for several or several tens of minutes before a chemical in a pack is completely dissolved while they continue kneading the chemical in the solution, thereafter users have to start dissolving a next chemical, thus requiring many hands and much time. Recently, photofinishing operations have been increasingly carried out by small laboratories. Further, recently, portable automatic developing machines and photofinishing machines have increasingly marketed for non-professional user operations with packs containing chemicals separately packed in a kit. Therefore, users find it difficult to distinguish the contents obtained in one pack from those contained in others, which leads to erroneous dissolvings of contents in packs. Needless to say, this causes serious photographic troubles, because recently photofinishing operations are carried out more and more by employees of camera shops.

In addition to such a trouble as described above, there has arisen one more serious problem, that is, photographic treatments have recently been carried out without water, so that no drainage pipes have become necessary and many automatic developing machines, in which respective over-flowed photographic processing solution is collected by a corresponding waste solution collecting tanks, have marketed. This is very desirable from the viewpoint of pollution prevention, however, serious accidents may occur: Although such machines are equipped with alarm buzzers to warn workers in charge that the waste solution collecting tanks has become full of a foul solution, there happens a case in which a worker forgets replacing the tank while they are engaged in other works, in which case, the waste solution flows on a floor, which may lead to a serious accident.

Now that a photographic processing operations performed only by professionals has been increasingly carried out by non-professional users, it can be safely said that they want a photographic processing solution housing pack which eliminates the need for a troublesome work of dissolving contents separately packed in a kit one by one and the need for operating photographical processing work without worrying about controlling a waste solution and keeps quality of a photographic processing solution.

The present invention further relates to a container of waste photographic treatment solution, and more specifically, to a container of waste solution capable of easily accommodating said waste solution into the waste solution collecting chamber even when there is no pressure applied to the waste solution.

Generally, in the photographic treatment of a silver halide photosensitive material, the development, fixing, and washing by water of a black-and-white photosensitive material or the processes of color development, bleach to fix (or bleaching and fixing), washing by water and stabilization have been performed by using a treating solution with one or 2 or more of said functions.

And in the photographic treatment processing a great deal of photosensitive materials, a means capable of replenishing consumed component by treatment on the one hand and capable of maintaining the performances of the processing solution by removing the increased components in it resulting from treatment (for example, a bromide iron in a developing solution, and silver complex salt in a fixing solution) on the other is employed. Thus a replenishing solution is supplied to the processing solution and part of the processing solution is discarded to remove an increased component in the aforementioned photographic treatment.

In recent years, from the viewpoint to prevent environmental pollution and to maintain cost performance ratio at a low level, there has been a tendency for such system to change to a system capable of accomplishing the object by using a substantially reduced replenishing amount of solution including rinsing water. The waste solution is led through a drainage tube from the treating tank of the automatic processor, and is then diluted by washing water and discarded into a sewer system.

In the meantime, from the viewpoint of a limitation in the available water resource, a rise in the cost of water supply and drainage, ease of installation of an automatic processor and working environment in the peripheral of an automatic processor, photographic treatment by means of an automatic processor (Nonwater washing automatic processor) that does not require a tubing for water supply and drainage for washing-water outside of the automatic processor has come to be widely used. It is said that, if possible, such a system should be devoid of cooling water also to maintain the processing solution at a constant temperature.

Under such photographic treatment, the only drainage solution from the automatic processor is a waste solution resulting from replacing by a replenishing solution and a photographic treatment system of this kind is characterized by its substantially reduced amount of waste solution compared with those having a water treatment system. Therefore, said system permits the removal of tubing outside of the developing processor for solution supply and drainage resulting in the overcoming of all of the following shortcomings inherent in the conventional automatic processor:

1. An automatic processor is difficult to be moved after installation because of tubing installed.

2. Conventional system afford only a small leg space and a great deal of money is required for tubing work upon installation.

3. Expenses related to energy to supply hot water are required.

This may bring such great advantages as to permit the automatic processor to be made compact and simplified to the extent whereby it can be used as an office machine.

The conventional automatic processors, however, require at least both a processing solution container that supplied a processing solution and a waste solution container that accommodates waste solution, though they are undoubtedly a compact equipment. When the waste solution container is used for color photography, a space for 2 solution each for color development, bleaching and fixing, and stabilizing treatment for non-water washing treatment totaling 6 containers must be provided.

Recently, an attempt has been made to use a so-called flexible container as a waste solution container aiming at the ease of handling as shown in FIG. 5, for example. A container of this kind is produced by sealing such material as laminate film and it is in a flat shape until it collects waste solution. And when collecting waste solution, opening portion 5 needs to be supported. Namely, when container 1 is created by using a flexible material, to stabilize the position of opening 5 of container 1 upon using it as a solution collecting container, an auxiliary plate 8 as shown in FIG. 5 is used. Said auxiliary plate 8 is formed by using such hard material as synthetic resins and metals and consists of top portion 9, side portion 10 and bottom portion 11. On the top portion 9, an opening fixing section 12 to fix opening 5 of container 1 is provided. The opening 5 should be fixed by being caught on said opening fixing section 12 and should be positioned just below the waste solution outlet.

The details of a photographic technology to use a waste solution container by dividing it into two with a partition have already been disclosed in Japanese patent publication open to public inspection (hereinafter referred to as Japanese patent O.P.I. publication) Nos. 55942/1980, 131155/1981 and 52065/1983 and Japanese utility model O.P.I. publication No. 94754/1981. A container in accordance with these techniques can serve simultaneously as a processing solution container and a waste solution container thereby saving a space for several containers.

When attempting to accommodate waste solution into a flexible waste solution container as shown in the aforementioned FIG. 5 or into one of the rooms divided into two mentioned above, it has become clear that unless the waste solution is given a sufficient pressure to enter the room of container by expanding the partition, the transfer of waste solution into said room may stop or waste solution may overflow. This problem may be solved by installing a pump in the waste solution line but it will push up the cost of the equipment.

SUMMARY OF THE INVENTION

It is therefore an oject of the present invention to provide a housing pack which has a high performance for maintaining the quality of a photographic processing solution in a high extent. It is another object of the present invention to provide a housing pack which eliminates the need for complicated dissolving the photographic processing solution. It is still another object to provide a housing pack which can collect a waste solution without fail.

After his energetic research, the inventor has invented a flexible housing pack, which is prepared for containing the photographic processing soulution for a photographic sensitive material of silver halide, comprising at least two partition chambers which are divided by a membrane partition member. One of said partition chambers is a photographic processing solution supplying chamber and the other is a waste solution collecting chamber. A housing member which forms said photographic processing solution supplying chamber and confronts the membrane partition member consists of a flexible synthetic resin film through which oxygen permeates below 20 ml/m$^2$/24 Hrs. at least one face of the membrane partition member of the photographic processing solution supplying chamber can be covered with a waste solution collected in the waste solution collecting chamber.

The present invention can be embodied by the construction in which (1) a housing pack comprises three sheets of flexible synthetic resin films and at least one of the films is a membrane partition member, and a housing member, which form a photographic processing solution supplying chamber, and confronts the membrane partition member, consists of a flexible synthetic resin film which contacts with outside air. (2) The entirety of one face of the membrane partition member forms a chamber for supplying a photographic processing solution and the entirety of the other face of the membrane partition member forms a waste solution collecting chamber. (3) The housing member confronting the membrane partition member, which form a photographic processing solution supplying chamber, consist of at least two layers of flexible synthetic resin films and at least one of the layers except the most inner layer capable of contacting with the solution is a layer selected from the group consisting of ethylene vinyl alcohol, aluminum foil and aluminum-evaporated synthetic resin film as an oxygen shelter member. (4) The housing member confronting the membrane partition member consists of a flexible synthetic resin film which permeates oxygen below 20 ml/m$^2$/24 Hrs: (5) The membrane partition member consists of at least two layers of flexible synthetic resin films and at least one layer except the most outer layer capable of contacting with the solution consists of ethylene vinyl alcohol, aluminum foil or aluminum-evaporated resin film.

The present invention is further intended to overcome existing technical problems by providing a waste solution container capable of easily accommodating waste solution into it without giving any pressure to the waste solution.

As a result of a whole-hearted study on a container capable of meeting the requirements, the inventor of the present invention has discovered that a waste photographic processing solution container characterized by its flexibility and having a material with solution absorption-expansion capabilities within it can overcome existing technical problems. Thus the present invention has come to be made.

A preferable embodiment of the invention is a waste solution container with at least two compartments divided by a partition of which one is a supply chamber for photographic treating solution and the other, a waste solution collecting chamber provided with a material having solution absorption and expansion capabilities.

BRIEF DESCRIPTION OF THE DRAWINGS

FIG. 1 shows the condition in which a photographic processing soluton is housed and a waste solution has not yet been collected in a waste solution collecting chamber.

FIG. 2 shows the condition in which a waste solution has been collected in a waste solution collecting chamber.

DETAILED DESCRIPTION OF THE INVENTION

Figure 1:
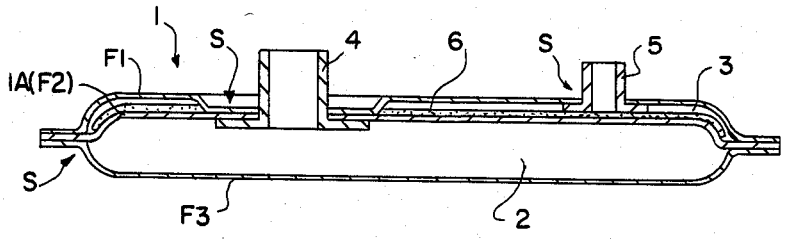
FIGS. 1 and 2 are sectional views showing one embodiment of the present invention.
Figure 2:
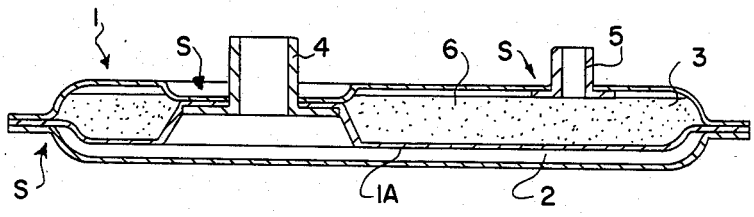

Referring now to the accompanying drawings, there is shown in FIGS. 1 and 2 a pack for housing a photographic processing solution.

FIGS. 1 and 2 are sectional views showing one embodiment of the present invention. FIG. 1 shows the condition in which a photographic processing solution is housed and a waste solution has not yet been collected in a waste solution housing chamber. FIG. 2 shows the condition in which a waste solution has been collected in a waste solution collecting chamber.

In FIGS. 1 and 2, numeral 1 designates a flexible bag-shaped housing pack made of resin which is divided by a membrane partition member into a chamber 2 for supplying a photographic processing solution and a waste solution collecting chamber. Numeral 4 denotes an opening provided with the supplying chamber 2. Numeral 5 indicates an opening provided with the waste solution collecting chamber 3.

The housing packs embodied in FIGS. 1 and 2 are constructed in such a manner described in detail hereinafter. One of the edge faces of a rectangular flexible film F2 composing a membrane partition member 1A is sealed by one of the edge faces of a rectangular flexible housing member F1 having a through hole for an opening 4 and an opening 5. A solution absorption expandable substance 6 may be interposed between the film F1 and the film F2 as necessary. The opening 4 provided on the rectangular flexible film F2 is sealed in such a condition that the opening 4 extends through the through hole of the rectangular flexible film F1. The above-described members as well as solution absorption-expandable substance 6 form the waste solution collecting chamber 3. Next, a flexible film F3 as another housing member which forms the supplying chamber 2 is sealed. Preferably, the openings 4 and 5 are provided with screws to mount lids thereon.

Incidentally, as one of preferred embodiments in the invention, the housing pack consisting of three sheets of the flexible films is explained above.

However, it may be possible to make the housing pack consisting of at least one sheet of the flexible films.

A photographic processing solution, to be housed in the waste solution collecting chamber 3, according to the invention, include monochrome developer, color developer, fixing solution, bleach-fix solution, bleaching solution, stabilizer, stop solution, image stabilizer, rinsing solution, stabilizing solution for non-water washing treatment. The specific gravity of the above-described solutions are more than 1.01. These solutions are independent or mixed solutions collected after processing photographic materials, or are waste solutions for reuse. Photographic processing solutions to be supplied with the supplying chamber 2 include the above-described photographic processing solutions.

Photographic processing solutions which are preferably used in a housing pack according to the invention include monochrome developer, color developer, fixing solution, bleach-fix bath, bleaching solution, stabilizing solution for non-water washing treatment. Preferably, solutions which contain preservatives such as sulfites, hydroxyamines and the like which are susceptible to oxidization, developing agents, thiosulfates, fungiside. Photographic processing solutions containing sulfites are most favorably applied to the housing pack of the invention.

Monochrome developers include at least one of hydroquinones, 1-phenol-3-pyrazolidones, and paraaminophenols.

As hydroquinones, those described in "The Theory of the Photographic Process (1977)" written by Mr. T. H. James can be used. Preferably, the amount of the hydroquinones to be used in a monochrome developer is 0.1 to 200 g/l. Specifically, hydroquinone, methylhydroquinone, 2,5-dimethylhydroquinone, 2-chlorohydroquinone, hydroquinone monosulfonic acid are used. Favorably, the amount of hydroquinone to be used in a monochrome developer is 0.1 to 200 g/l. More favorably, it ranges from 1 to 100 g/l. Most favorably, it ranges from 2 to 50 g/l.

1-phenyl-3-pyrazoridones are disclosed in UK Pat. No. 943,928, No. 1,093,281, U.S. Pat. No. 2,289,367, No. 3,241,967, and No. 3,453,109. These patent specifications disclose 1-phenyl-3-pyrazoridones which have substituent groups at 2-position, 4-position and/or 5-position of 3-pyrazoridone ring For example, 4-hydroxymethyl-4-methyl-1-phenyl-3-pyrazoridone, 4,4-dihydroxylmethyl-1-phenyl-3-pyrazolidone, 4-methyl-1-phenyl-3-pyrazolidone, 4,4-dimenthyl-1-phenyl-3-pyrazolidone are used. 1-phenyl-3-pyrazolidone and compounds which have substituent groups at 4-position of 3-pyrazolidone ring are most faborably used.

As paraaminophenyls, those described on pages from 311 to 315 in "The Theory of the Photographic Process" (1977) written by Mr. T. H. James can be used. They are paraaminophenyl, N-methyl-paraaminophenol, and 3-methyl-paraaminophenol. Favorable quantity of 1-phenyl-3-pyrazolidones and/or paraaminophenols to be used in a monochrome developer is in the range from 0.01 to 100 g/l. More favorably, it ranges from 0.05 to 50 g/l. Most favorably, it ranges from 0.1 to 10 g/l.

In addition to the hydroquinones and 1-phenyl-3-pyrazolidones and/or paraaminophols, monochrome developers can contain various components which are normally added thereto as desired.

Favorably, the pH of a monochrome developer according to the invention is in the range from 8.5 to 11.5.

More favorably, it ranges from 9.0 to 11.0. Favorably, the temperature for treating the monochrome developer ranges from 10° to 60° C. More favorably, it ranges 20° to 50° C.

As a color developing agent to be employed as a color developing solution, aromatic primary amine is preferable. In addition to this, various compounds used widely in processing color photograph films are contained in the color developing agent. These compounds are used as salts thereof, for example, hydrochloride or sulfate because these compounds are more stable in combined state than in free state. These compounds are used in concentration from about 0.1 g to about 30 g per one liter of the color developer. Preferably, they are used in concentration from about 1 g to about 15 g per one liter of the color developer.

Useful aromatic primary amine color developers consist of N,N-dialkyl-p-phenylenediamines. The alkyl and phenyl groups of these compounds may contain proper substituents. These substituents include N,N-diethyl-p-phenylenediamine hydrochloride, N-ethyl-N-β-methansulfonic amidethyl-3-methyl-4-amino-aniline sulfate, 4-amino-3-methyl-N-ethyl-N-β-hydroxyethylethylaniline sulfate, 4-amino-N-(β-methyoxyethyl)-N-ethyl-3-methylaniline-p-toluenesulfonate, N, N-diethyl-3-(β-methanesulfonamidethyl)-4-aminoaniline sulfate.

A color developer may contain developing components known in the art in addition to the above-described aromatic primary amine color developers. Preservatives are one of the components which may be contained in a color developing solution. The preservatives include alkali metal sulfites, alkali metal bisulfites, aldehyde and ketone compounds to which bisulfites have been added, water-soluble salts of hydroxylamine, for example, sulfates, hydrochloride, and phosphates. Alkalis and buffer agents may also be contained in a color developing solution. The alkalis and buffer agents include sodium hydroxide, silicates, sodium carbonate, potassium metaborate, boric acid, and phosphates. These alkalis and buffer agents are added to a color developing solution independently or in combination thereof. Disodium hydrogenphosphate and sodium bicarbonate may be used to moderate or increase the ionic strength of the color developing solution.

Inorganic or organic anti-fogging agents may be added to the color developing solution as necessary. Typical agents of the anti-fogging agents include inorganic halides such as potassium bromide, potassium iodide, 6-nitrobenzoimidazole disclosed in U.S. Pat. No. 2,496,940, 5-nitrobenzoimidazole disclosed in U.S. Pat. No. 2,497,917 and No. 2,656,271 or heterocyclic compounds disclosed in Japanese patent examined publication No. 41675/1971.

Besides the above-described various components, restrainers disclosed in Japanese patent examined publication No. 19039/1981, No. 6149/1980, and U.S. Pat. No. 3,259,976 and accelerators may be added to the color developing solution as necessary. The accelerators include piridinium compounds disclosed in U.S. Pat. No. 2,648,604 and No. 3,671,247, and Japanese patent examined publication No. 9503/1969; cationic compounds, cationic pigments such as phenosafranine, normal salts such as thallous nitrate; polyethylene glycol and its derivatives, nonionic compounds such as polythioether and the like disclosed in U.S. Pat. No. 2,533,990, No. 2,531,832, No. 2,950,970, No. 2,577,127, and Japanese patent examined publication No. 9504/1969; organic solvents, organic amine, ethanolamine, ethylenediamine, diethanolamine, triethanolamine disclosed in Japanese patent examined publication No. 9509/1969. Other effective accelerators are benzyl alcohol and phenethyl alcohol disclosed in U.S. Pat. No. 2,304,925 and acethylene glycol, methyl ethyl ketone, cyclohexane, thioethers, pyridine, ammonia, hydrazine, and amines. The following substances may be used as organic solvents which increase solubility of a developing agent such as ethylene glycol, methylcellosolve, methanol, acetone, dimethylformamide, β-cyclodextrin, and compounds disclosed in Japanese patent examined publication No. 33378/1972 and No. 9509/1975.

A color developing solution may contain chelating agents which act as water softeners and heavy metal sealing agents. These chelating agents include phosphates such as polyphosphates, aminopolycarboxylic acids such as nitrilotriacetic acid, 1,3-diaminopropanoltetraacetic acid, diethylenetriaminepentaacetic acid, hydroxyethyliminodiacetic acid, oxycarboxylic acids such as citric acid and gluconic acid, organic acids such as 1-hydroxyethylidene-1,1-diphosphonic acid, aminopolyphosphonic acids such as aminotri (methylenephosphonic acid), polyhydroxy compounds such as 1,2-dihidroxybenzene-3,5-disulfonic acid.

In addition to the above-described chelating agents, following substances may be added to a color developing solution as necessary, for example, competitive couplers such as citrazinic acid, tin chelating compounds such as tin N,N,N-trimethylene phosphonate which acts as a fogging agent, tin chelating agents such as tin citrate, boron hydride compounds such as tert-butylamine boron, colored couplers, couplers of development inhibit-release type (so-called DIR coupler) or compounds which acts as releasing development inhibiting agents.

The favorable pH range of the developing agents is from 8 to 14, but more favorably, from 9.5 to 14. Most favorably, 11.5 to 13.5.

The preferable compounds to be used as a stabilizing solution for non-water washing according to the invention is chelating agents whose chelating stability constant with respect to iron ion is over eight. They are very preferable to accomplish the object of the invention.

The chelating stability constant is referred to as the constants described in "Stability Constants of Metal Ion Complexes" which was written by Mr. L. G. Sillen and Mr. A. E. Martell and published by The Chemical Society, London (1964) and "Organic Sequestering Agents" written by Mr. S. Chaberek and Mr. A. E. Martell and published by Wiley (1959).

The preferable chelating agents, to be added to a stabilizing solution for non-water washing according to the invention, whose chelation stability constant with respect to iron ion is over eight are selected from organic carboxylic acid, organic phosphoric acid, inorganic phosphoric acid, polyhydroxyl compounds and the like. The iron ion described above is referred to as ferric iron ion.

Compounds whose chelation stability constant with respect to ferric iron ion is over eight include diaminopropenetetraacetic acid, nitrilotriacetic acid, hydroxyethylenediamine triacetic acid, iminodiacetic acid, diethylenetriaminepentaacetic acid, hydroxyethyliminodiacetic acid, diaminopropanoltetraacetic acid, transcyclohexanediaminetetraacetic acid, glycoletherdiaminetetraacetic aicd, ethylenediaminetetrakismethylenephosphonic acid, nitrilotrimethylenephosphonic acid, 1-hydroxyethylidene-1,1-diphosphonic acid, 2-phosphonobutane-1,2,4-tricarboxylic acid, catechol-3,5-diphosphonic acid, sodium pyrophosphate, sodium tetrapolyphosphate, and sodium hexametaphosphate. Favorably, diethylenetriaminepentaacetic acid, nitrilotriacetic acid, nitrilotrimethylenephosphonic acide, 1-hydroxyethylidene-1,1-diphosphonic acid are used. The most favorable one of the above is 1-hydroxyethylidene-1,1-diphosphonic acid.

The amount of the above-described chelating agents to be added to a stabilizing solution for non-water washing treatment ranges favorably 0.01 to 50 g per one liter thereof. More favorably, it ranges from 0.05 to 20 g.

The most favorable compound to be added to a stabilizing solution for non-water washing treatment is ammonium compounds.

The ammonium compounds described above are selected from inorganic ammonium salts. These ammonium salts are ammonium hydroxide, ammonium bromide, ammonium carbonate, ammonium chloride, ammonium phosphate, ammonium bicarbonate, ammonium hydrogensulfate, ammonium sulfate, ammonium nitrate, ammonium acetate, ammonium benzoate, ammonium citrate, ammonium formate, ammonium thiosulfate, ammonium sulfite, ammonium ethylenediamine tetraacetate, ferric ammonium ethylenediaminetetraacetate, ammonium maleate, ammonium oxalate, ammonium phthalate, ammonium salicylate, ammonium succinate, ammonium sulfanilate, ammonium thiosulfate, ammonium chloride, ammonium sulfate, and ammonium hydroxide are the most favorable ammonium compounds to obtain the desired result.

The amount of ammonium compounds to be added to a stabilizing solution for non-water washing treatment ranges favorably more than $1.0\times10^{-5}$ mol per one liter of the stabilizing solution. More favorably, it is in the range from 0.001 to 5.0 mol. Most favorably, it ranges from 0.002 to 1.0 mol.

It is preferable that a stabilizing solution for non-water washing treatment according to the invention contain a sulfite in the range in which no bacteria is generated.

Both organic and inorganic sulfites can be contained in a stabilizing solution for non-water washing treatment according to the invention provided that they emit bisulfite ions, however, inorganic sulfites are more favorable than organic sulfites. Preferable sulfites are sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, bissodium bisulfite glutaraldehyde, bissodium bisulfite succinicaldehyde.

Favorably, the moles of these sulfites to be contained in one liter of a stabilizing solution for non-water washing treatment ranges at least $1.0\times10^{-5}$ mol/l. More favorably, they are added thereto in the range from $5\times10^{-5}$ moles/l to $1.0\times10^{-1}$/l.

Preferably, a stabilizing solution for non-water washing treatment contain a fungicide, whereby desulfurization and image keeping performances can be improved.

Following substances can be used as fungicides. Substances of isothiazoline class, benzimidazole class, benzisothiazoline class, thiabendazole class, phenol class; organic substance having halogen groups; mercapto class compounds, benzoic acid and its derivatives. Isothiazoline class, benzisothiazoline class, thiabendazole class are favorable than others. Substances of isothiazoline class, benisothiazoline class, and thiabendazole class are most favorable.

Following compounds are favorably used as fungicides, however, other fungicides can be used.

Example compound (1) 2-methyl-4-isothiazoline-3-one
(2) 5-chloro-2-methyl-4-isothiazoline-3-one
(3) 2-methyl-5-phenyl-4-isothiazoline-3-one
(4) 4-bromo-5-chloro-2-methyl-4-isothiazoline-3-one
(5) 2-hydroxylmethyl-4-isothiazoline-3-one
(6) 2-(2-ethoxyethyl)-4-isothiazoline-3-one
(7) 2-(methyl-carbamoyl)-4-isothiazoline-3-one
(8) 5-bromoethyl-2-(N-dichlorophenyl-carbamoyl)-4-isothiazoline-3-one
(9) 5-chloro-2-(2-phenylethyl)-4-isothiazoline-3-one
(10) 4-methyl-2-(3,4-dichlorophenyl)-4-isothiazoine-3-one
(11) 1,2-benzisothiazoline-3-one
(12) 2-(2-bromoethyl)-1,2-benzisothiazoline-3-one
(13) 2-methyl-1,2-benzisothiazoline-3-one
(14) 2-ethyl-5-nitro-1,2-benzisothiazol-3-one
(15) 2-benzyl-1,2-benzisothiazoline-3-one
(16) 5-chloro-1,2-benzisothiazoline-3-one
(17) hydroxybenzoic acid
(18) thiabendazole The methods of synthesizing these compounds and applying them to other uses are disclosed in U.S. Pat. No. 2,767,172, No. 2,767,173, No. 2,870,015, UK Pat. No. 848,130, and French Pat. No. 1,555,416. Besides the these compounds, they are sold in the trade names of Topcide 300, Topcide 600 (manufactured by Permachem Asia Corporation), Finecide J-700 (manufactured by Tokyo Fine Chemical Corporation), and Proxel GXL (manufactured by I.C.I. Corporation)

The amount to be added to one liter of a stabilizing solution for non-water washing treatment is favorably in the range from 0.001 to 50 g. More favorably, it ranges from 0.01 to 20 g per one liter of a stabilizing solution for non-water washing treatment.

The favorable pH range of a stabilizing solution for non-water washing treatment of the invention is in the range from 3.0 to 9.5. More favorably, it ranges from 3.5 to 9.0. This pH range is suitable for preventing precitating compounds contained in the stabilizing solution for non-water washing treatment.

As compounds which can be added to a stabilizing solution for the non-water washing treatment according to the invention, followings are available; organic salts such as citric acid, acetic acid, succinic acid, oxalic acid, benzoic acid and the like, pH buffers such as phosphoric acid, borate, hydrochloric acid, sulfuric acid, and the like, surface active agents, antiseptics, metal salts of Bi, Mg, Zn, Ni, Al, Sn, Ti, Zr, and the like. These compounds are needed to maintain the pH of the stabilizing solution for non-water washing treatment according to the invention. They can be used in any desired combination provided that the compounds added to the stabilizing solution for non-water washing treatment prevents a color-photographed image from being damaged during preservation and the compounds from being precipitated therein.

Any kinds of bleaching agents can be applied to bleaches or bleach-fix baths. They include red prussiates of potash and ferrous chloride disclosed in UK Pat. No. 736,881 and Japanese Patent Examined Publication No. 44424/1981, persulfuric acid disclosed in German Pat. No. 2,141,199, hydrogen peroxide disclosed in Japanese Patent Examined Publication No. 11616/1983 and No. 11618/1983, and organic ferric complex salts such as organic ferric complex salt of ferric complex salt ethylenediaminetetraacetate.

The most favorable bleaching agents to be used in accordance with the invention are organic complex salts of ferric iron such as:

(1) diethylenetriamine pentaacetic acid
(2) diethylenetriaminepentamethylenephosphonic acid
(3) cyclohexanediaminetetraacetic acid
(4) ethylenediaminetetraacetic acid
(5) methyliminodiacetic acid
(6) propyliminodiacetic acid
(7) triethylenetetraminehexaacetic acid
(8) triethylenetetraminehexamethylenephosphonic acid
(9) glycol etherdiaminetetraacetic acid
(10) 1,2-diaminopropanetetraacetic acid
(11) 1,2-diaminopropanetetramethylenephosphnic acid
(12) 1,3-diaminopropane-2-oletetraacetic acid
(13) ethylenediaminetetramethylenephosphonic acid
(14) N-hydroxyethyliminodiacetic acid These organic ferric complex salts are used in the form of free acids, alkali metal salts such as sodium salts, potassium salts, lithium salts, ammonium salts, or water-soluble amine salts such as triethanolamide. Potassium salts, sodium salts, and ammonium salts are preferable. The use of one of these ferric complex salts suffice, however, the use in combination of more than one of these ferric complex salts may be also used as necessary. The amount of these ferric complex salts to be used depends on the amount of silver and the composition of silver halides contained in a sensitive material to be treated. Since these ferric complex salts are oxidative, they can be used at a concentration lower than aminopocarboxylate, for example, more than 0.01 moles per one liter. Preferably, they can be used at 0.05 to 0.06 moles. It is preferable that these organic ferric complex salts are added to a replenisher to the solubility limit thereof to thicken the replenisher.

A bleaching solution or a bleach-fix bath can be used in pH range from 0.2 to 9.5. Favorably, it is from 4 to 9. More favorably, it is from 5.5 to 8.5.

A bleaching solution can contain the above-described organic ferric complex salts which act as a bleaching agent and various additives. It is preferable to contain alkali halides or ammonium halides in the bleaching solution as additives such as ammonium bromide, potassium iodide, ammonium iodide, and the like. Following substances may be also added to the bleaching solution as necessary: pH-buffers such as borate, oxalate, acetate, carbonate, phosphate; solubilizers such as triethanolamine; well-known additives such as acetylacetone, phosphonocarboxylic acid, polyphosphoric acid, organic phosphonic acid, oxycarboxylic acid, polycarboxylic acid, alkylamines, polyethyleneoxide.

Following bleach-fix baths can be used: Solutions containing a little amount of halogen compounds such as potassium bromide, and those containing much quantities of halogen compounds such as potassium bromide and ammonium bromide; those specially prepared by combining a bleaching agent according to the invention with much quantities of halogen compounds such as potassium bromide.

In addition to the above-described halogen compounds, following halogen compounds may also be contained in a bleaching solution; hydrochloric acid, hydrobromic acid, lithium bromide, sodium bromide, ammonium bromide, potassium iodide, sodium iodide, ammonium iodide, and the like.

Following are silver halide-fixing agents to be contained in a bleach-fix bath. These agents reacts with silver halide to form water-soluble complex salts and are used for fixing other compounds: Thiosulfates such as potassium thiosulfate, sodium thiosulfate, ammonium thiosulfate; thiocyanates such as potassium thiocyanate, sodium thiocyanate, and ammonium thiocyanate; thiourea; thioether; concentrated bromides; iodies. These fixing agents are used in such a condition that they can dissolve in a bleach-fix bath more than 5 g per liter. Favorably, they dissolve therein more than 50 g per liter. More favorably, it dissolves more than 70 g per liter therein.

A bleach-fix bath can contain pH-buffers as in the case of the above-described bleaching solution independently or in combination of the following salts; boric acid, borax, sodium hydroxide, potassium hydroxide, sodium carbonate, potassium carbonate, sodium bicarbonate, potassium bicarbonate, acetic acid, sodium acetate, ammonium hydroxide. Besides pH-buffers following agents may be added to the bleach-fix bath. They include fluorescent whitening agents, anti-foam agents, surface active agents, or fungicides. Further, following agents may be added to the bleach-fix bath as necessary. They are preservatives such as hydroxyamine, hydrazine, sulfites, isomeric bisulfites, aldehyde and ketone compounds to which bisulfites have been added; organic chelating agents such as acethylacetone, phosphonic carboxylic acid, polyphosphoric acid, organic phosphonic acid, oxycarboxylic acid, polycarboxylic acid, dicarboxylic acid, and aminopolycarboxylic acid; stabilizers such as nitroalcohol and nitrates; solubilizing agents such as alkanolamine, stain-prevention agent such as organic amins; additives; organic solvents such as methanol, dimethylformamide, and dimethylsulfoxide.

If a photographic processing solution of the invention is a fixing solution, following fixing agents can be used: Thiosulfates disclosed in Japanese Patent Publication Open to Public Inspection No. 185435/1982, thiocyanates disclosed in UK Pat. No. 565,135 and Japanese Patent Publication Open to Public Inspection No. 137143/1979, halides disclosed in Japanese Patent Publication Open to Public Inspection No. 130639/1977, thioether disclosed in Belgian Pat. No. 626970, thiourea disclosed in UK Pat. No. 1,189,416. In addition to these fixing agents, the above-described fixing solutions can contain pH-buffering agents independently or in combination of the following salts as in the case of the above-described bleach-fix bath; boric acid, borax, sodium hydroxide, potassium hydroxide, sodium carbonate, potassium carbonate, sodium bicarbonate, potassium bicarbonate, acetic acid, sodium acetate, ammonium hydroxide. Furthermore, fluorescent whitening agents, anti-foam agents, surface active agents, and fungicides. In addition, the above-described fixing solutions can contain following substances; Preservatives such as hydroxyamine, hydrazine, sulfites, isomeric bisulfites, aldehyde and ketone compounds to which bisulfites have been added; organic chelating agents such as acetylacetone, phosphonic carboxylic acid, polyphosphoric acid, organic phosphonic acid, oxycarboxylic acid, polycarboxylic acid, dicarboxylic acid, and aminopolycarboxylic acid; stabilizers such as nitroalcohol and nitrate; solubilizing agents such as alkanolamine and stain-prevention agents; additives; organic solvents such as methanol, dimethylformamide, and dimethylsulfoxide.

A photographic processing solution capable of being applied to the invention may be a processing solution for processing sensitive materials, a replenisher therefor or a prepared agents which is a thickened replenishers of part or all of the components to be used for treating the processing solutions.

A film as the housing member to be used for a housing pack of the invention are made of flexible synthetic resin through which oxygen permeates less than 20 $ml/m^2/24$ Hr. The oxygen permeation amount can be measured by the methods known in the art. The above-described oxygen permeation amount is the value measured under the condition in which atmospheric pressure is one and the temperature was 20° C., and relative humidity was 65%.

The flexible synthetic resin film, to be used in the invention, through which oxygen permeates below 20 $ml/m^2/24$ Hr is described hereinafter.

Flexible synthetic resin films according to the invention may be composed of a layer of resin membrane consisting of high polymer or more than two layers consisting of high polymer. A layer of resin membrane consisting of high polymer which meets the requirement of the invention include:

(1) polyethylene terephthalate (PET) which is more 0.1 mm in thickness
(2) acrylonitrilebutadiene copolymer which is more than 0.3 mm in thickness
(3) hydrochlorinated rubber which is more than 0.1 mm in thickness Of the above-described high polymer resins, polyethylene terephthalate is most preferred in that it is superior in alkali and acid resistances.

High polymer resins, to be used in lamination, which meet the requirement of the invention are as follows:

(4) PET/copolymer of polyvinyl alcohol and ethylene (E val)/polyethylene (PE)
(5) stretched polypropylene (OPP)/E val/PE
(6) non-stretched polypropylene (CPP)/E val/PE
(7) nylon (N)/aluminum foil (Al)/PE
(8) PET/Al/PE
(9) cellophane/PE/Al/PE
(10) Al/paper/PE
(11) PET/PE/Al/PE
(12) N/PE/Al/PE
(13) paper/PE/Al/PE
(14) PET/Al/PET/polypropylene (PP)
(15) PET/Al/PET/high-density polyethylene (HDPE)
(16) Al/PE/low-density polyethylene (LDPE)
(17) EVA/PP
(18) PET/Al/PP
(19) paper/Al/PE
(20) PE/PVDC coated nylon/PE/condensate of ethyl vinyl acetate and polyethylene
(21) PE/PVDC coated N/PE
(22) EVA/PE/aluminum-evaporated nylon/-PE/EVA
(23) aluminum-evaporated nylon/N/PE/EVA
(24) OPP/PVDC-coated N/PE
(25) PE/PVDC-coated N/PE
(26) OPP/E val/LDPE
(27) OPP/E val/CPP
(28) PET/E val/LDPE (29) ON (stretched nylon)/E val/LDPE
(30) CN (non-stretched nylon)/E val/LDPE Of the above-described high polymer resins, those from

(20 ) to (30) are preferable.

The thickness of these films vary according to the kind thereof. Favorable thickness ranges from 0.5 μm to 500 μm. More favorably, the thickness ranges from 1 μm to 200 μm.

A photographic processing solution is filled in a supplying chamber 2 shown in FIG. 1. The photographic processing solution is supplied with an unshown automatic developing machine through an opening 4.

A waste solution is fed from the automatic developing machine into a waste solution collecting chamber 3 through an opening 5. With the increase of the waste solution which is to be introduced into the waste solution collecting chamber 3, it wets or dip a membrane partition member 1A, with the result that no air permeation occurs in the membrane partition member 1A and the photographic processing solution is prevented from being oxidezed, i.e., it does not degrade while it is preserved in the supplying chamber 2. The condition of the housing pack changes as shown in FIG. 2 as the photographic processing solution decreases in the supplying chamber 2.

The above is a description of one embodiment of the invention, however, the embodiment of the invention is not limited to this.

Figure 4:
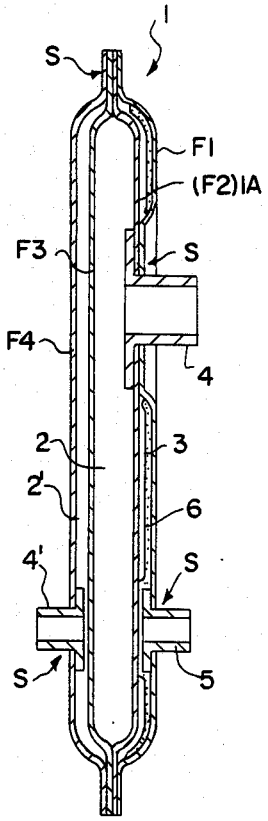

The configuration of a housing tank 1 is not limited to that shown in the drawings, but the invention may be embodied using other configurations provided that a housing tank is provided with more than two chambers. For example, the configuration shown in FIG. 4 may be used to embody the invention. The same numerals as those in FIGS, 1 and 2 indicate the members corresponding to those in FIGS. 1 and 2. The housing tank shown in FIG. 4 is provided with another supplying chamber 2' which has an opening 4'. In this embodiment, a flexible film F4 is used in addition. The opening 4' may be protruded at the side where the opening 5 is provided like the opening 4. Preferably, a solution absorption-expandable substance 6 is provided. It may be placed on the membrane partition member 1A or fixed thereto or fixed to the inner wall F1 of the housing tank 1. It is preferable that the membrane partition member 1A (F2) is stretched by the expansion of the solution absorption-expandable substance 6. Preferably, the membrane partition member 1A is made of a stretchy and flexible synthetic resin sheet or film which is used independently or in lamination. A rubber sheet which is made of either natural or synthetic rubber may also be used as the membrane partition member 1A provided that it is chemical-resistant.

The rubber sheet through which oxygen permeates in the range according to the invention can be preferably used as a material for the membrane partition member 1A. When a flexible synthetic resin film according to the invention is used for a membrane partition member of which both surfaces are possibly contacted with the solution, it is preferable that the membrane partition member consist of at least 2 layers in which the flexible synthetic resin film according to the invention is applied to the layer contacting with the waste solution.

It is preferable that a flexible synthetic resin film according to the invention is used as the membrane composing the waste solution collecting chamber 3.

EXAMPLE

Hereafter, the present invention will be further explained, showing detailed examples.

Example 1

A color developing replenisher containing the contents described below was prepared. Two pieces of housing packs for each of six kinds of housing packs which are made of different resins and can contain five liters of a photographic processing solution were prepared for experiments. The housing packs have the contruction shown in FIG. 1. Four liters of a color devleoping replenisher was put into the photographic processing solution supplying chambers, respectively and one liter of a color developing waste solution was put into the waste solution collecting chambers of the housing packs of one group, respectively. Five liters of color devleoping replenishers were put into the photographic processing solution supplying chamber and the color developing waste solutions were not put into any of the six housing packs of the other group.

These housing packs were preserved in a thermostatic chamber for two weeks at 50° C. to measure reduction percentage of sulfurous acid ions in the color developing replenishers.

The compositions of the membrane partition members F2 and the housing member F3, which confront the membrane partition members F2 and form photographic processing chambers, and the oxygen permeation amount through these member are shown in Table 1. LDPEs with 50 μm thickness were used as the material for the housing member F1 which compse the waste solution collecting chamber confronting the membrane partition member F2. The oxygen permeation amount through the housing member F1 was 2700 ml/m$^2$/24 Hr. The results are shown in Table 1.

Color developing replenisher described above consists of the following substances:

| | |
|---|---|
| Benzyl alcohol | 18 ml |
| Diethylene glycol | 10 ml |
| Fluorescent whitening agent Tinopal SEP (manufactured by Ciba Geigy Co., Ltd.) | 2 g |
| Hydroxylamine sulfate | 4 g |
| 3-methyl-4-amino-N—ethyl-N—(β-methansulfonamidethyl)-aniline sulfate | 7 g |
| Potassium carbonate | |
| Potassium sulfite (50% water solution) | 6 ml |
| potassium hydroxide | 2.3 g |

Water was added to the above mixture to form one liter of a water solution.

TABLE 1

| | Membrane (F3) | | Membrane pertition member (F2) | | | |
|---|---|---|---|---|---|---|
| Sample No. | Layer construction | Oxygen permeation amount (ml/m$^2$/24 Hrs) | Layer construction | Oxygen permeation amount (ml/m$^2$/24 Hrs) | Waste solution | Reduction percentage of sulfurous acid ion |
| 1 | ON (20 μm) | 28 | ON (20 μm) | 28 | Not present | 90% |
| 2 | ON (20 μm) | 28 | ON (20 μm) | 28 | Present | 78% |
| 3 | PE (50 μm)/ PVDC coat N (25 μm)/ PE (55 μm) | 10 | ON (20 μm) | 28 | Not present | 85% |
| 4 | PE (50 μm)/ PVDC coat N (25 μm)/ PE (55 μm) | 10 | ON (20 μm) | 28 | Present | 52% |
| 5 | ON (15 μm)/ Eval (15 μm)/ LDPE (50 μm) | 0.6 | ON (20 μm) | 28 | Not present | 80% |
| 6 | ON (15 μm)/ Eval (15 μm)/ LDPE (50 μm) | 0.6 | ON (20 μm) | 28 | Present | 28% |
| 7 | PE (50 μm)/ PVDC coat N (25 μm)/ PE (55 μm) | 10 | PE (50 μm)/ PVDC coat N (25 μm)/ PE (55 μm) | 10 | Not present | 76% |
| 8 | PE (50 μm)/ PVDC coat N (25 μm)/ PE (55 μm) | 10 | PE (50 μm)/ PVDC coat N (25 μm)/ PE (55 μm) | 10 | Present | 42% |
| 9 | ON (15 μm)/ Eval (15 μm)/ LDPE (50 μm) | 0.6 | PE (50 μm)/ PVDC coat N (25 μm)/ PE (55 μm) | 10 | Not present | 72% |
| 10 | ON (15 μm)/ Eval (15 μm)/ PE (55 μm) | 0.6 | PE (50 μm)/ PVDC coat N (25 μm)/ PE (55 μm) | 10 | Present | 28% |
| 11 | PE (50 μm)/ PE (55 μm) | 2.5 | PE (50 μm)/ PVDC coat N (25 μm) PE (55 μm) | 10 | Not present | 74% |
| 12 | PE (50 μm)/ PE (55 μm) | 2.5 | PE (50 μm)/ PVDC coat N (25 μm)/ PE (55 μm) | 10 | Present | 36% |

Table 1 indicates that oxygen permeation amount through the membrane F3 is below 20 ml/m$^2$/24 Hr and that when a waste solution is present in the waste solution collecting chambers, the reduction percentage of sulfurous acid ions in the color developing solution is very low, and, when the oxygen permeation amount through the membrane partition member F2 is lower than 20 ml/m$^2$/24 Hr, this reduction percentage becomes further low.

Example 2

Experiments were conducted in the manner similar to that performed in example 1. In this experiment, a bleach-fix replenisher was used instead of color developing replenisher. The bleach-fix replenisher was preserved in a thermostatic chamber for a week at 50° C. to measure the reduction percentage of sulfurous acid ions.

The bleach-fix replenisher consists of the following substances:

| | |
|---|---|
| Ammonium ethylenediaminetetraacetate | 75 g |
| Ammonium sulfite | 10 g |
| Ammonium thiosulfate | 110 g |
| Ammonia water (28%) | 10 ml |

Water was added to the above mixture to form one liter of water solution. The pH of the mixture was adjusted to 6.5 by using acetic acid and ammonia water. The result is shown in Table 2. The samples No. 13 through 24 in Table 2 correspond to the sample No. 1 through 12 in Table 1.

TABLE 2

| Sample No. | Reduction percentage of sulfurous acid ion |
|---|---|
| 13 | 98% |
| 14 | 87% |
| 15 | 93% |
| 16 | 61% |
| 17 | 91% |
| 18 | 38% |
| 19 | 84% |
| 20 | 52% |
| 21 | 80% |
| 22 | 38% |
| 23 | 82% |
| 24 | 41% |

As apparent from Table 2, the result obtained by using a bleach-fix replenisher is similar to that obtained by using a color developing replenisher.

Example 3

Five liters of color developing replenishers same as those used in Example 1 were put into photographic processing chambers in the housing packs whose membranes F3 and F1 were formed by the composition shown in Table 3. The housing packs used in this embodiment were similar to those used in Example 1. The openings of the photographic processing supplying chamber were connected to bellows pumps equipped with color paper automatic developing machines. The housing packs were provided with pipes to feed color developing replenishers to color developing tanks. The openings of the waste solution collecting chamber were connected to over-flow pipes so as to flow the color developing waste solution to the waste solution collecting chambers. The amount of color paper was adjusted such that about 200 ml color developing replenisher were introduced into the color developing tanks a day. Experiments were conducted for 24 hours to measure the reduction percentages of sulfurous acid ions in the color developing replenishers housed in the photographic processing solution supplying chambers of the housing packs. The result is shown in Table 3.

TABLE 3

| Sample No. | Construction of membrane (F3) and membrane partition member (F2) | Oxygen permeation amount ($ml/m^2/24$ Hrs) | Reduction percentage of sulfurous acid ion |
|---|---|---|---|
| 25 | PET (12 μm)/Eval (15 μm)/ LDPE (50 μm) | 0.5 | 23% |
| 26 | Aluminum-evaporated nylon/ N (20 μm)/PE (50 μm)/ EVA (20 μm) | 0.7 | 24% |
| 27 | OPP (20 μm)/Eval (15 μm)/ CPP (50 μm) | 6 | 27% |

TABLE 3-continued

| Sample No. | Construction of membrane (F3) and membrane partition member (F2) | Oxygen permeation amount ($ml/m^2/24$ Hrs) | Reduction percentage of sulfurous acid ion |
|---|---|---|---|
| 28 | OPP (20 μm)/Eval (15 μm)/ LDPE (50 μm) | 20 | 32% |
| 29 | EVA (20 μm)/PE (20 μm)/ Aluminum-evaporated nylon (15 μm)/PE (20 μm)/EVA (20 μm) | 3 | 26% |
| 30 | OPP (20 μm)/PVDC coat N (25 μm)/PE (50 μm) | 1.7 | 25% |
| 31 | PE (20 μm)/PVDC coat N (15 μm)/PE (20 μm)/ EVA (20 μm) | 1.2 | 25% |
| 32 | ON (31 μm) | | 60% |
| 33 | PET (20 μm) | | 65% |

As apparent from Table 3, the reduction percentages of sulfurous acid ion are very low when housing packs in which membranes F3 and F1, which permit oxygen to pass therethrough in the amount less than 20 $ml/m^2/24$ Hr, were used.

A preferable embodiment of another aspect in the invention is a waste solution container with at least two compartments divided by a partition of which one is a supply chamber for photographic treating solution and the other, a waste solution collecting chamber provided with a solution absorption-expandable material.

Detailed description of preferred embodiments of the invention is made hereunder by referring to the attached drawings.

FIGS. 1 and 2 are cross sectional diagrams already aforementioned in detail. FIG. 1 is a status of a container when photographic processing solution is accommodated into the supply chamber and before a solution absorption-expandable material starts absorbing waste solution. FIG. 2 is a status of a container when the solution absorption expandable material had become expanded by absorbing waste solution and extended the partition.

In FIG. 1, numeral 1 is a waste solution container, and said waste colution container 1 is a flexible bag made of resin. Its inside is divided into two with a partition member 1A inbetween; one is supply chamber 2 that supplies photographic processing solution and the other, waste solution chamber 3. Numeral 4 is an opening provided in the supply chamber 2 that supplies photographic processing solution and numeral 5 is an opening provided in the waste solution chamber 3.

Detailed structure of an embodiment shown in FIGS. 1 and 2 is as follows:

Referring now to the drawing of an embodiment of the invention, the end of a square-shaped flexible film F2 constituting partition 1A along the end of a square-shaped flexible film F1 with a penetrating hole for opening 4, and another opening 5 is sealed S while interposing the solution absorption expandable material 6 inbetween.

At this time, said square-shaped flexible film F2 has an opening 4, and this opening 4 is sealed in a state in which it penetrated the penetrating hole of the aforementioned square-shaped flexible film F1. In this way, a waste solution chamber 3 provided with the solution absorption expandable material 6 is formed. Next, a flexible film F3 that constitutes a solution supply chamber 2 is sealed. Note that it is desirable that the openings 4 and 5 be provided with a screw thread portion to put a lid on them.

Numeral 6 is a solution absorption expandable material and it is accommodated in the waste solution chamber so that it can press and move the partition 1A by getting expanded by absorbing the solution. The accommodated amount of said solution absorption expandable material may be optionally determined according to the object.

The solution absorption expandable material 6 is a material capable of absorbing said waste solution and of expanding by itself when the waste solution entered the opening 5. It is best to use a resin with high solution absorption capabilities.

Among resins with high solution absorption capabilities, the following materials can be used.

Seed polysacharides including guar gum, locust bean gum, guince seed gum, tara gum, etc.

Seaweeds polysaccharides including carrageenan, alginic acid, furcellaran and agar.

Resin polysaccharides including gum arabinogalactan, gum arabic, gum tragacanth, gum karaya etc.

Fruit polysaccharides including pectin.

Rootstock polysaccharides including starch, devil's tongue, grated yam, and mallow.

Further, following materials can also be used: Gum xanthan, zanflo, curdran, succino glucan, syzofiran, pullulan gelatin, casein, albumin, and shellac etc.

Those that are oxidized, or converted to a carboxymethyl, hydroxymethyl, hudroxypropyl, carboxymethylhydroxypropyl and amine as a starch derivative, or a derivative of gum gua, gum locust bean and cellulose.

Among a derivative of alginic acid are alginic acid ammonium, alginic acid plopyleneglycolester, etc.

Among vinyl materials are povol, polyvinylpyrrolidone and plyvinylmethacrylate, etc.

Among acrylic materials are polyacrylic acid soda, and polyacrylicamido, etc.

Besides those mentioned above, such material as polyethyleneoxide can also be used.

Next, preferable examples of resins with high solution absorption capabilities that can be used in accordance the invention are described.

(A) Graft starch (A-1) Starch acrylonitrile graft copolymer (A-2) Starch acrylic acid graft copolymer The above-mentioned material (A-1) can be produced in accordance with methods described in Japanese patent O.P.I. publication No. 43395/1974 and U.S. Pat. No. 4,134,863, and the material (A-2) can be produced in accordance with a method described in Japanese official patent publication No. 53-46199.

(B) Acrylic acid material (B-1) Polyacrylic acid soda material (B-2) Vinyl alcohol acrylin acid copolymer material The material (B-2) mentioned above can be used repeatedly by means of natural drying or forced drying.

(C) Copolymer material with a chemical composition having repeating units shown in (I) or (II) below, preferably a copolymer containing an amount of from 10 wt% to 70 wt% of (I) and/or (II) and constituting itself by copolymerizing with other ethylene unsaturated monomer.

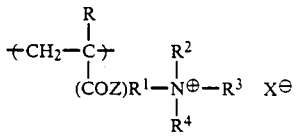

(I)

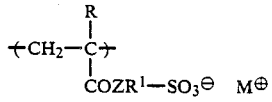

(II)

In the aforementioned chemical formulas, R is a hydrogen atom, or a methyl group or a halogen atom; Z, an oxygroup or an imino group; n, 0 or 1; $R^1$, an alkylene group (including a substituent alkylene group) with 1 to 6 carbon atoms, or a cycloalkylene group with 5 to 6 carbon atoms or an arylene group with 5 to 6 carbon atoms, or an arylenealkylene group or an arylene visalkylene group. Here, said alkylene portion has 1 to 6 carbon atoms and said arylene portion (those substituted can also be used) has 6 to 10 carbon atoms. They also include arylene replaced by such hydrophilic polar group as shown by a chemical formula of

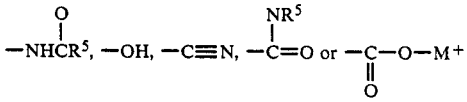

($R^5$ in said chemical formula is an alkyl group with 1 to 4 carbon atoms).

Each of $R^2$, $R^3$ and $R^4$ is an alkyl group with a hydrogen atom or 1 to 6 carbon atoms. Or they constitute a complex cyclic group capable of optionally containing sulfur or oxygen atom by joining with N.

M is an ammonium group containing No. 4 ammonium cation with an alkyl group having a soluble cation or less than 6 carbon atoms. X is an acid anion.

Halogen substituted group on R can be replaced by bromine or chlorine. Alkylene groung of $R^1$ with 1 to 6 carbon atoms can be replaced by a hydroxyl group. Arylenealkylene group of $R^1$ contains a phenylenemethylene group, phenyleneethylene group, phenylenepolopylene group, and a phenylenefutylene group and an arylenevisalkylene group of $R^1$ contains a phenylenedimethylene group.

Among soluble cation M are sodium and potassium. Among complex cyclic groups consisting of $R^2$, $R^3$ and $R^4$ and an N atom formed by uniting these substances are pyrinidium, imidazolium, oxazolium, thiazolium and molholium.

Among acid anion X family are chloride, bromide, acetate, p-toluene sulfonate, methane sulfonate methyl sulfate ethane sulfonate methyl sulfate, etyl sulfate an perchlorate.

Among materials consisting of monomer from which repeated units (1) and (2) can be derivated are:

N-(2-acryloyloxyethyl)-N, N, N-trimethylammonium chloride.

N-(2-hydroxy-3-methacryoyloxypropyl)-N, N, N-trimethylammonium chloride.

N-(3-acrylamidopropyl) pyridiniumchloride.

N-(2-hydroxy-3-methacryloyloxypropyl)-N, N, N-trimethylammonium-chloride.

N-(2-methacryloyloxyethyl)-N, N, N-trimethylammoniumiodide

N-(2-methacryloyloxyethyl)-N, N, N-trimethylammonium p-toluensulfonate
N-(2-methacryloyloxyethyl)-N, N, N-trimethylammoniummethylsulfate
N-(2-methacryloyloxyethyl)-N, N, N-trimethylammonium acetate
N-(2-methacryloyloxyethyl)-N, N, N-trimethylammonium bromide
N-(2-methacryloyloxyethyl)-N, N, N-trimethylammoniumchloride
N-(2-methacrylicoxyethyl)-N, N, N-trimethylammoniumethylsulfonate
N-(2-methacryloyloxyethyl)-N, N, N-trimethylammoniumnitrate
N-(2-methacryloyloxyethyl)-N, N, N-trimethylammoniumphosphate
N-(3-acrylamido-3, 3-dimethylpropyl)-N, N, N-trimethylammoniummethyl sulfate
N-vinylbenzyl-N, N, N-trimethylammoniumchloride
N-benzyl-N, N-dimethyl-N-vinylbenzylchloride
N, N, N-trihexyl-N-vinylbenzylammoniumchloride
N-(2-aminoethyl)methacrylamidohydrochloride
2-aminoethylmethacrylatehydrochloride
N-(3-aminopropyl) methacryamidohydrochloride
4-(N, N-dimethylamino)-1-methylbutylacrylatehydrochloride
2-(N, N-Diethylamino) ethylacrylatehydrochloride
2-(N, N-diethylamino) ethylmethacrylatehydrochloride
3-(N, N-dimethylamino) propylacrylatehydrochloride
N-(1, 1, 3-trimethylaminopropyl) acrylamidehydrochloride
2-(N, N-dimethylamino) ethylacrylatehydrochloride
2-(N, N-dimethylamino) ethylmethacrylate hydrochloride
N-(2-dimethylaminoethyl)acrylamidehydrochloride
N-(2-dimethylaminoethyl) methacrylamidohydrochloride,
3-(N, N-dimethylamino) propylacrylamidohydrochloride
Sodium 4-acryloyloxybutane-1-sulfonate
Sodium 3-acryloyloxybutane-1-sulfonate
Sodium 3-acryloyloxypropane-1-sulfonate
Sodium 2-acrylamido-2-methylpropanesulfonate
Sodium 3-acrylamidopropane-1-sulfonate
Sodium 2-methacryloyloxyethyl-1-sulfonate
Sodiumacryloyloxymethylsulfonate
Sodium 4-methacryloyloxybutane-1-sulfonate
Sodium 2-methacryloyloxyethane-1-sulfonate
Sodium 3-methacryloyloxypropane-1-sulfonate
Sodium 2-acrylamidopropane-1-sulfonate
Sodium 2-methacrylamide-2-methylpropane-1-sulfonate and
Sodium 3-acrylamide-3-methybutane-1-sulfonate.

one or more kinds of monomers with a group capable of bridging, for example, 2-hydroxyethylmethacrylate, 2-hydroxyethylacrylate or a monomer containing an active methylene group are desirable for ethylene unsaturated monomer to be copolymerized with the monomer described in the aforementioned general formula (I) and/or the one described in the aforementioned general formula (II). The details of a polymerized copolymeric ethylene unsaturated monomer of this kind have been disclosed in the U.S. Pat. Nos. 3,459,790, 3,488,708, 3,554,987, 3,658,878, 3,929,482, and 3,939,130.

Polymers that are desirable for use in the aforementioned applications should have a unit ranging from 10 wt% to 70 wt% induced or repeated from one or more kinds of monomers mentioned below.

2-aminoethylmethacrylatehydrochloride,
N-(2-methacryloyloxyethyl)-N, N, N-trimethylammoniumchloride,
N-(2-methacryloyloxyethyl)-N, N, N-trimethylammoniummetsulphate,
Sodium 2-methacryloyloxyethyl-1-sulfonate, and
2-(N, N-dimethylamino) ethylmethacrylatehydrochloride.

A non-acid added salt with a chemical formula that coincides with the aforementioned chemical formula (I) can be converted to a free amine by neutralizing it with base.

The above-mentioned polymer can be prepared under a conventional method by polymerizing and allowing an appropriate monomer to react in a water solution.

The monomers with a chemical formula identical to the aforementioned chemical formula (I) can be prepared in accordance with methods described in a book entitled Funotionali Monomers, by R. H. Yocum and E. B. Nyquist, Marcel Dekker, Inc., New York (1974) and in the U.S. Pat. No. 2,780,604. The monomers with a chemical formula identical to the aforementioned chemical formula (II) can be prepared in accordance with methods described in the U.S. Pat. Nos. 3,024,221 and 3,506,707.

When necessary, this polymer can be prepared by converting a polymer with an (a) amine group to class 4 by using an alkylating agent or by permitting (b) amine to react with a group capable of reacting with this amine, for example, by permitting (b) amine to react with a polymer with an active halogen group. Such methods have already been known in the technical field and the details of the methods have been disclosed in the U.S. Pat. Nos. 3,488,706, and 3,709,690, and Canadian Pat. No. 601,958.

The aforementioned resins can also be obtained in the market.

Among articles available on the market are Sumikagel N-100, Sumikagel SP-520, Sumikagel S-50, Sumikagel NP-1020, Sumikagel F-03, Sumikagel F-51, Sumikagel F-75, Sumikagel R-30 (those mentioned above are manufactured by Sumitomo Chemical Industry Co., Ltd.), Sunwet 1M-300, Sunwet 1M-1000 (those mentioned above are manufactured by Sanyo Chemical Industry Co., Ltd.), Aquakeep IOSH-P (Manufactured by Seitetsu Chemical Co., Ltd.), Langile F (Nihon Exran Co., Ltd.).

It is desirable that a resin with high solution absorption capabilities that is capable of being shaped into a shape suitable to absorb solution easily be used in accordance with the present invention. Those that are in a powdered state or in a granular state with a diameter ranging from 0.01 mm to 3 mm are most suitable for use.

In the present invention, a waste solution absorbed by the solution absorption expandable material 6 consists of one or more than two kinds of solutions that have been used in the photographic material treatment. Such waste solutions is the used photographic processing solution, with a specific gravity of mor than 1.01, consisting of one kind or mixed solution of black and white developing solution, color developing solution, fixing solution, bleaching and fixing solution, bleaching solution, stabilizing solution, stopping solution, image stabilizing solution, rinsing solution and stabilizing solution substituting for washing. The waste solution may be reused, when necessary. On the other hand, photographic treating solution is the aforementioned various kinds of photographic processing solutions themselves or part of these solutions. Also, waste photographic processing solution to be treated in accordance with the invention may consist of a single solution overflowed from each treating tank or a mixed solution containing more than two kinds of different solutions, or a portion of these solution enritched by evaporation, or those that had been treated to collect silver or for other purposes.

The supply chamber 2 shown in FIG. 1 is full of a photographic processing solution. At this stage, the processing solution is fed into an unshown automatic developing machine through the opening 4.

Waste solution is transferred from the developing machine to the waste solution collecting chamber 3 through the opening 5. During this process, the waste solution, which receives no artificial pressure, is in contact with the solution absorption-expandable substance 6 in the waste solution chamber 3, and is absorbed into the substance. When the absorption process continues, as the solution absorption-expandable substance 6 expands and at the same time the solution in the solution supply chamber 2 decreaes in volume, making the interior of the supply chamber 2 gradually form the shape shown in FIG. 2.

One example according to the invention was described, above, however, the scope of embodiments according to the invention is not necessarily limited only to such an example.

Figure 3:
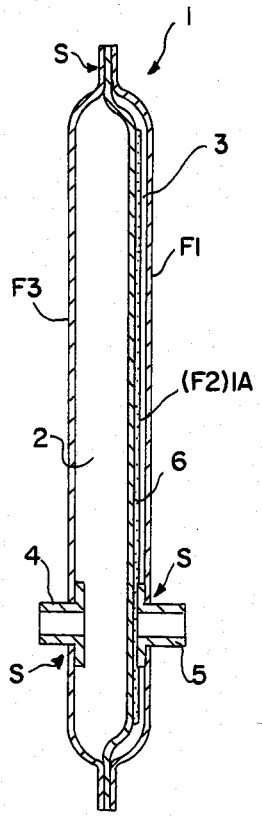
FIGS. 3, 4 and 5 are sectional views showing another embodiment of the present invention.

The solution container 1, for example, may take constitutions other than those shown in FIGS., and, more specifically, such as those shown in FIGS. 3 and 4, in which the numerals correspond to the components denoted by the same numerals in FIGS. 1 and 2, mentioned above. The embodiment in FIG. 3 is an example having the openings 4 and 5 which are diagonally opposite to each other. The embodiment in FIG. 4 is an example which has another supply chamber 2' with independently provided opening 4'. In this case, another flexible film F4 may be used to provide such a supply chamber. Additionally, the opening 4' may like the opening 4, protrude to the side where the opening 5 is provided. Furthermore, with the present invention, the solution absorption-expandable substance 6 may be internally provided within a flexible waste solution container, or, apart from the examples, above, such a container may be prepared in accordance with the following; (a) Japanese patent publication open to public inspection (hereinafter referred to as Japanese patent O.P.I. publication) No. 55942/1980; (b) Japanese patent O.P.I. publication No. 131155/1981; (c) Japanese patent O.P.I. publication No. 52065/1983; (d) Japanese utility model publication open to public inspection No. 94754/1981. With (a), above, the solution absorption-expandable substance 6 of the invention is internally provided inside or outside the central chamber; with, (b), above, the solution absorption-expansion substance 6 of the invention is internally provided within a chamber separated from another by means of a membrane partition member; with (c), above, the solution absorption-expandable substance 6 of the invention is internally provided within the waste solution receiver 10E disposed between the replenisher bag 10B and the bottle 10A; with (d), above, the solution absorption-expandable substances 6 is provided within the external bag or internal bag.

In Figs. the shape of solution absorption-expandable substance 6 is illustrated as layers. However, the substance may be arbitrarily formed into round shape, square shape or others. Additionally, the scope of the installing method for the solution absorption-expandable substance 6 is not limited. For example, the substance may be placed on the membrane partition member 1A, or secured on the partition member 1A, or secured on the internal wall F1 of the solution container 1.

The membrane partition member 1A should be, preferably, able to expand in response to the expansion of the solution absorption-expandable substance 6, and, for example an expansive or flexible synthesized resin sheet or a film (including laminated ones) or a rubber sheet (whichever of natural rubber or synthesized rubber, if chemically resistant) may be employed for this purpose. For the films F1, F2 and F3, those made of flexible synthesized resin sheet or films (whichever laminated or not) are preferable, however, a non-flexible material may serve this purpose.

The present invention is described in detail in the following section by referring to the specific examples, however, the scope of embodiments of the invention is not necessarily limited only to these examples.

After image-wise exposure, Sakura Color SR paper (manufactured by Konishiroku Photo Industry Co., Ltd.) was continuously treated with the following processes and processing solutions.

| Standard treatments | | |
|---|---|---|
| (1) Color develpoment | 38° C. | 3 min 30 sec |
| (2) Bleach-fixing | 38° C. | 1 min 30 sec |
| (3) Stabilizing | 25 ~ 35° C. | 3 min |
| (4) Drying | 75 ~ 100° C. | Approx. 2 min |

Solution compositions

| [Color developer in tank] | |
|---|---|
| Benzyl alcohol | 15 ml |
| Ethylene glycol | 15 ml |
| Potassium sulfite | 2.0 g |
| Sodium bromide | 1.3 g |
| Sodium chloride | 0.2 g |
| Potassium carbonate | 24.0 g |
| 3-methyl-4-amino-N—(β-methanesulfonamidethyl) aniline sulfate | 4.5 g |
| Optical brightening agent (4,4'-diaminostilbenzsulfonic acid derivative) (product name: Keicall PK-conc, manufactured by Shinnichiso Chemical Industry Co., Ltd.) | 1.0 g |
| Hydroxylamine sulfate | 3.0 g |
| 1-hydroxyethylidene-1,1-diphosphonic acid | 0.4 g |
| Hydroxyethyliminodiacatic acid | 5.0 g |
| Magnesium chloride hexahydride | 0.7 g |
| Disodium 1,2-hydroxybenzene-3,5-disulfonate | 0.2 g |

Water was added to prepare one l solution, which was treated with potassium hydroxide and sulfuric acid so as to attain the pH value 10.20.

| [Color developer replenisher] | |
|---|---|
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| 3-methyl-4-amino-N—ethyl-N—(β-methanesulfonamidethyl) aniline sulfate | 6.0 g |
| Optical brightening agent (4,4'-diaminostilbenzsulfonic acid derivative (product name: Keicall PK-conc, manufactured by Shinnichiso Chemical Industry Co., Ltd.) | 2.5 g |
| 1-hydroxyethylidene-1,1-diphosphonic acid | 0.5 g |
| Hydroxyethyliminodiacatic acid | 5.0 g |
| Magnesium chloride, hexahydrate | 0.8 g |

-continued

| [Color developer replenisher] | |
|---|---|
| Disodium 1,2-hydroxybenzene-3,5-disulfonate | 0.3 g |

Water was added to prepare one l solution, which was treated with potassium hydroxide so as to attain the pH value of 10.70.

| [Bleach-fixer in tank] | |
|---|---|
| Ferric ammonium ethylenediaminetetraacetic acid dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Water was added to prepare one l solution, which was treated with potassium carbonate or glacial acetic acid so as to attain the pH value 7.1.

| [Bleach-fixer replenisher A] | |
|---|---|
| Ferric ammonium ethylenediaminetetraacetic acid dihydrate | 260.0 |
| Potassium carbonate | 42.0 g |
| Water was added to prepare one l solution. The pH value of this solution is 6.7 ± 0.1. | |
| [Bleach-fixer replenisher B] | |
| Ammonium thiosulfate (70% solution) | 500.0 ml |
| Ammonium sulfite (40% solution) | 250.0 ml |
| Ethylenediaminetetraacetic acid | 17.0 g |
| Glacial acetic acid | 85.0 ml |

Water was added to prepare one l solution. The pH value of this solution is 5.3±0.1.

| [Stabilizing solution for non-water washing treatment contained in tank and replenisher] | |
|---|---|
| Ethylene glycol | 1.0 g |
| 1-hydroxyethylidene-1,2-diphosfonic acid (60% aqueous solution) | 1.0 g |
| Ammonia water (ammonium hydroxide: 25% aqueous solution) | 2.0 g |

Water was added to prepare one l solution, which was treated with sulfuric acid so as to have the pH value 7.0.

The above-mentioned color developer contained in a tank, the bleach-fixer contained in a tank and the stabilizing agent contained in a tank were poured into an automatic developing machine, wherein the previously-mentioned Sakura Color SR paper sample was treated and the running test was exercised by replenishing the above-mentioned color developer replenisher and the bleach-fixer replenishers A and B as well as the stabilizing solution replenisher with a measuring cup every three minutes. The amounts of replenishers per square meter color paper were as follows; 190 ml into the color developer tank; 50 ml into the bleach-fixer tank for each of bleach-fixer replenishers A and B; 250 ml stabilizing solution replenisher for non-water washing treatment into the stabilizing tank. The stabilizing tank in the automatic developing machine comprises a multiple counter-current flow tank involving three tanks, the first through the third tanks, in the flow direction of the sample, and, the replenishment is effectd from the last tank whose overflow solution is allowed to flow into the second tank, and, whose overflow solution is further allowed to flow into the first tank.

The treatment was continued until the total replenishment of the stabilizing solution for non-water washing treatment became three times as great as the capacity of the stabilizing tank.

The overflow solution derived from the above-mentioned treatment was allowed to freely flow into the waste solution container, below. Such overflow solution was at the same time a photographic processing waste solution (A) comprising a mixture having the following mixing ratio: [overflow solution of color developer]:[overflow solution of bleach-fixer]:[overflow solution of solution for non-water washing treatment]=3:3:5.

EXAMPLE 4

Figure 5:
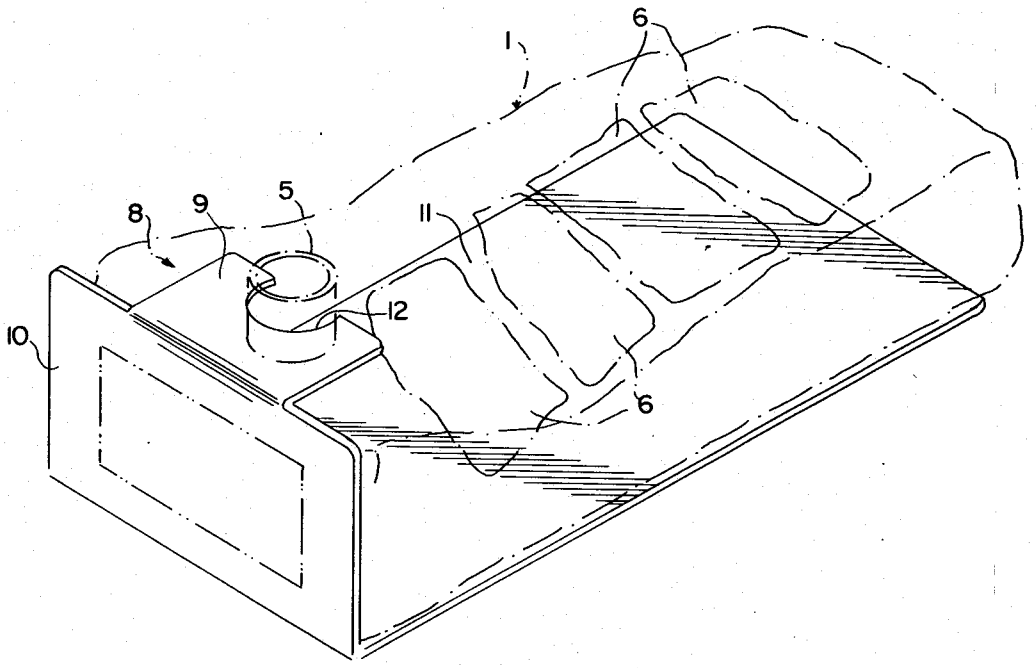

Three flexible solution containers commonly having the constitution shown in FIG. 5 were prepared, each of them comprised as follows; (1) polyethylene terephthalate sheet; (2) three-layer lamination sheet involving polyethylene terephthalate, copolymer of polyvinyl alcohol-ethylene and polyethylene; (3) aluminum-deposited nylon. The flexible solution containers were respectively provided with 20 g high-hygroscopic resin (Sumikagel N-100 manufactured by Sumitomo Chemical Co., Ltd.) inside thereof in which the high-hygroscopic resin has high solution absorption capabilities. When the above-mentioned photographic processing solution (A) was allowed to freely flow into the waste solution containers, the waste solution (A) was absorbed and stored with Sumikagel N-100 without any overflow.

EXAMPLE 5

With Example 4, the high-hygroscopic resin was replaced with Sumikagel S-50 and the experiment was conducted in the same manner as for Example 4. The waste solution (A) was absorbed and stored with Sumikagel S-50 without any overflow.

EXAMPLE 6

The flexible solution container shown in FIG. 1 and comprising aluminum-deposited nylon for F1, polyvinyl alcoholethylene copolymer for F2 and polyethylene for F3 was prepared, and, the waste solution was allowed to flow into the container in the same manner as Examples 4 and 5. The waste solution was stored without any overflow.

COMPARISON EXAMPLES 4~6

With Examples 4~6, the experiment was conducted without using the high-hygroscopic resin, and, in every case, the waste solution (A) failed to freely flow into the container, overflowing from it and making the storage impossible.

With a preferable embodiment of another aspect in the present invention, a solution supply chamber feeding an arbitrarily employed solution is a photographic processing solution supply chamber, and, a waste solution collecting chamber containing a solution absorption substance is floating on a photographic processing solution stored in the photographic processing solution supply chamber.

The examples according to the present invention are described, below, with the reference to the attached drawings.

Figure 7:
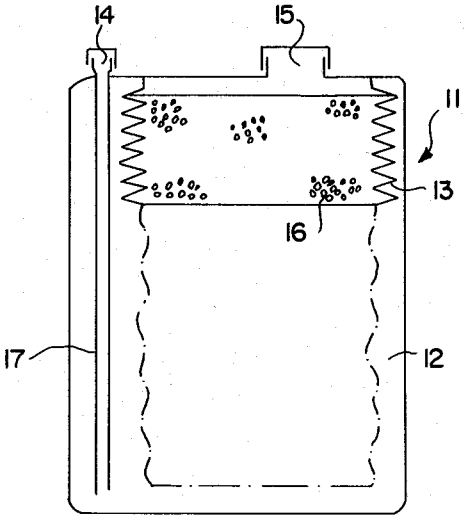
Figure 6:
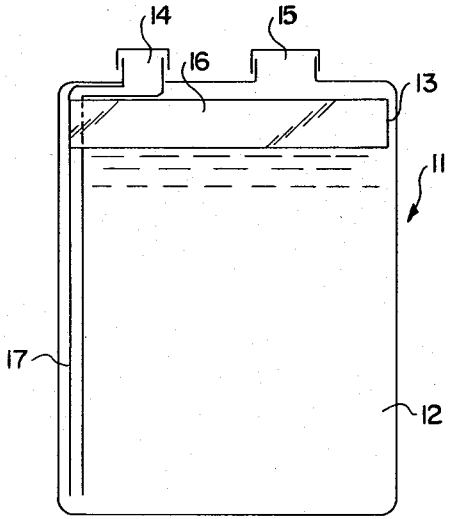

FIGS. 6 and 7 are the schematic cross-sections of one embodiment, according to the invention, wherein a photographic processing solution is contained in a solution supply chamber while a solution absorption substance has not yet absorbed waste solution.

In each figure, the numeral 11 denotes the main body of the photographic processing solution container, wherein the solution supply chamber 12 containing an optional liquid comprises the lower compartment occupying the larger portion of the interior thereof, and, the area occupying the upper portion of the interior is provided with the waste solution collecting chamber 13 which draws and collects waste solution derived from photographic processing solution. The liquid to be stored in the solution feed chamber 12 can be any type of solution, however, it should be preferably a photographic processing solution replenisher or a start solution. Additionally, the waste solution collecting chamber 13 according to the invention should be preferably floating on the photographic processing solution stored in the solution supply chamber 12. More specifically, the container should be preferably so structured that the waste solution collecting chamber 13 descends due to a load on it as the waste solution accumulates in the waste solution collecting chamber 13 through the opening 15, and, at the same time, as the photographic processing solution flows out the solution supply chamber 12 through the opening 14.

For this purpose, the waste solution collecting chamber 13 may be, as shown in FIG. 6, so structured that it forms a pontoon which descends according to the drop in liquid level in the solution supply chamber 12, or, the chamber 13 may be, as shown in FIG. 7, so structured that it forms a bellows which can expand in accordance with the amount of the collected waste solution.

For the example in FIG. 6, the area between the inner wall of the container 11 and the external wall of the waste solution collecting chamber 13 may not necessarily be liquid-tight, though the area should be preferably liquid-tight. Additionally, the pontoon-like waste solution collecting chamber 13 may be made of a light weight material, having relative gravity less than one, such as foamed styrene.

Naturally, the top of the waste solution collecting chamber 13 of the invention may be left open.

The openings 14 and 15 should be preferably provided with threading for lids.

The numeral 16 denotes a solution absorption substance which is contained within the waste solution collecting chamber 13 so that the substance may absorb large amount of liquid by expansion due to absorption of liquid. The amount of the solution absorption substance may be arbitrarily determined in accordance with the nature of application. Additionally, the numeral 17 in Figs. denotes a tube.

The solution absorption-expandable substance 16 should preferably have such characteristics as to absorb waste solution and expand itself when the waste solution flows through the opening 5, and, a high-hygroscopic resin is favorably used for this purpose.

Solution supply room 12 shown in FIGS. 6 and 7 is filled with a photographic processing solution. Under this state, the processing solution is supplied to an automatic processor (not shown) through opening 14.

The waste solution of said automatic processor is fed into waste solution room 13 after passing through an opening 15. At this time, the waste solution to which no pressure is intentionally applied comes into contact with a solution absorption expandable material 16 inside the waste solution room 13 and is then absorbed by it. At this absorption continues, the solution absorption expandable material 16 will expand, causing the waste solution room 13 to become heavier, simultaneously reducing solution in the solution supply room 12. Subsequently, the waste solution 13 will fall in a state in which it is floating on the solution of the solution supply room 12. Note that in the case of the embodiment of the invention shown in FIG. 7, a bellow-shaped waste solution room 13 is compressed and expands.

The invention has been described in detail with particular reference to one preferred embodiment thereof, but it will be understood that variations and modifications can be effected within the spirit and scope of the invention.

Figure 8:
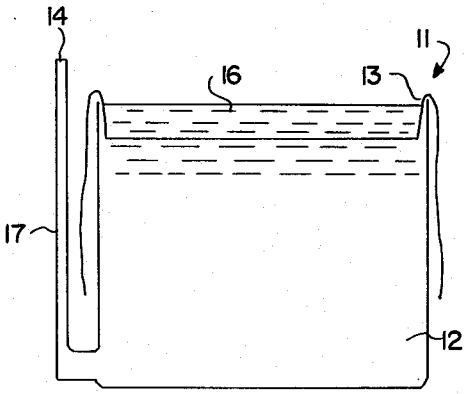
FIGS. 6, 7 and 8 are sectional views showing still another embodiment of the present invention.

The shape of a photographic treating solution container main body 11 is not limited to the one illustrated. In concrete terms, a shape shown in FIG. 8 may also be used. Namely, in the said diagram and FIGS. 6 and 7 mentioned above, like numeral references denote like elements. In the embodiment shown in FIG. 8, the side wall of waste solution room 13 consists of a flexible sheet and as the waste solution room 13 sinks, said flexible sheet will sink into the solution supply room 12.

Although the shape of solution absorption expandable material 16 is illustrated as being in layers, it is not limited to this shape and can be made to any shape. Further, there is no restriction in the manner to provide the solution absorption expandable material 16. It may be mounted on the bottom of the waste solution room 3, or may be fixed to any part of it.

The present invention is described in detail with reference to preferred embodiments therefore but the application of the invention is not limited to such embodiments.

After completing printing off of a Sakura Color SR paper (manufactured by Konishiroku Photo Industry Co., Ltd.), continuous treatments have been performed by using the following treating processes and solutions.

| Standard treating process | | |
|---|---|---|
| (1) Color development | 38° C. | 3 minutes 30 seconds |
| (2) Bleaching and fixing | 38° C. | 1 minute 30 seconds |
| (3) Stabilizing treatment | 25° C. ~ 35° C. | 3 minutes |
| (4) Drying | 75° C. ~ 100° C. | About 2 minutes |

Composition of a treating solution

[Color development tank solution]

| | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 24.0 g |
| 3-methyl-4-amino-N—ethyl-N—(β-methanesulfonamideothyl) aniline sulfate | 4.5 g |
| Optical brightening agent (4,4'-diaminostilbenzsulfonic acid derivative) (Article name: Keicall PK-Conc (manufactured by Shinnichiso Chemical Industry Co., Ltd.) | 1.0 g |
| Hydroxylamine sulfate | 3.0 g |
| 1-hydroxyethyliden-1,1-diphosphonic acid | 0.4 g |
| Hydroxyethylimino diacetic acid | 5.0 g |
| Magnesium chloride hexahydrate | 0.7 g |
| Disodium 1,2-hydroxybenzen-3,5-disulfonate | 0.2 g |

Add water to the solution to make it to a total amount of 1 l and subsequently make it to attain pH 10.20 by adding potassium hydroxide and sulfuric acid to it.

| (Color Development Replenishing Solution) | |
|---|---|
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| 3-methyl-4-amino-N—ethyl-N (β-methanesulfonamidoethyl) aniline sulfate | 6.0 g |
| Optical brightening agent (4,4'-diaminostilbenzsulfonic acid derivative) (Article name: Keicall PK-Conc, manufactured by Shinnichiso Chemical Industry Co., Ltd.) | 2.5 g |
| 1-hydroxyethylidene -1,1-diphosphonic acid | 0.5 g |
| Hydroxyethyliminodiaccetic acid | 5.0 g |
| Magnesium chloride hexahydrate | 0.8 g |
| Disodium 1,2-hydroxybenzene-3,5-disulfonate | 0.3 g |

Add water to solution to make it to a total amount of 1 l and subsequently make it to attain pH 10.70 by additing potassium hydroxide to it.

| (Bleaching and Fixing Tank Solution) | |
|---|---|
| Ferric ammonium ethylenediaminetetraaccetic acid dihydrate | 60.0 g |
| Ethylenediaminetetraaccetic acid | 3.0 g |
| Thioammonium sulfate (70% solution) | 100.0 ml |
| Ammonium sulfite (40% solution) | 27.5 ml |

Add water to make it to a total amount of 1 l and subsequently adjust it to attain pH 7.1 by adding potassium carbonate or glacial acetic acid to it.

| [Bleaching and Fixing Replenishing Solution] | |
|---|---|
| Ferric ammonium ethylenediaminetetraacetic acid dihydrate | 80.0 g |
| Thioammonium sulfate (70% solution) | 150.0 ml |
| Ammonium sulfite | 50.0 ml |
| Ethylenediaminetetraaccetic acid | 5.0 g |

Add water to make it to a total amount of 1 l. The pH of this solution is 6.8±0.1.

| [Stabilizing solution for non-water washing treatment contained in tank and replenisher] | |
|---|---|
| Ethylene glycol | 1.0 g |
| 1-hydroxyethylidene-1,1-diphosphonic acid (60% water solution) | 1.0 g |
| Ammonia water (Ammonium hydroxide solution) | 2.0 g |

Add water to make it to a total amount of 1 l and make it to attain pH 7.0 by adding sulfuric acid to it.

The automatic processor was filled with the aforementioned color developing tank solution, bleaching and fixing tank solution and stabilization tank solution. Subsequently a running test was conducted by treating the above-mentioned Sakura Color SR paper test material while replenishing said color developing solution, bleaching and fixing solution and stabilizing solution through a fixed amount cup at every 3 minutes. The replenished amounts of the solutions per color paper 1 $m^2$ were:

1. An amount of 190 ml of color development solution to the color developing tank.
2. An amount of 150 ml of bleaching and fixing solution to the bleaching and fixing tank.
3. An amount of 250 ml of stabilizing solution to substitute for washing to the stabilizing tank.

Note that the stabilizing tanks of the automatic processor were arranged from the 1st tank to the 3rd tank in the direction of the flowing of test material. Solution was replenished beginning from the last tank, the solution overflowed from the last tank was flowed into the previous tank and the solution overflowed from the second tank was flowed into the first tank; thus a multiple tank overflow system was employed.

EXAMPLE 7

Three polypropylene photographic processing solution containers structured in the same was as shown in FIG. 6 were prepared. The aforementioned color development replenishing solution, bleaching and fixing replenishing solution and stabilizing solution for non-water washing treatment were put into each of these containers. Subsequently, a waste solution room consisting of a polypropylene made waste solution container was floated and an amount of 20 g of resin with high solution absorption capabilities (Sumikagel N-100, manufactured by Sumitomo Chemical Co., Ltd.) was put into the said waste solution container. The above-mentioned three kinds of replenishing solutions were replenished into the automatic processor simultaneously permitting relevant overflowing solution to naturally flow into the waste solution concainer. The said overflowing solution was observed to have been absorbed by Sumikagel N-100, and the waste solution container gradually descended. Thus, waste solution had comme to be stored without overflowing.

EXAMPLE 8

Similar tests were conducted by substituting Sumikagel S-50 manufactured by Sumitomo Chemical Co., Ltd. for the resin with high solution absorption capabilities in the embodiment 1. The overflowing solution was observed to have been absorbed by Sumikagel S-50 and the waste solution container gradually ascended. Thus the overflowing solution had come to be stored without overflowing.

EXAMPLE 9

A bellow-shaped waste solution container consisting of polyethylene sheet structured in the same way as shown in FIG. 7 was perpared. Subsequently, overflowing solution tests similar to those in the case of example 7 and 8 were conducted. The bellow was observed to have gradually expanded and the overflowing solution had come to be stored without overflowing.

COMPARISON OF EXAMPLES 1 THROUGH 3

In the example 1 through 3, similar tests were performed without using a resin with high solution absorption capabilities. In all cases, the overflowing solution did not naturally flow into the container but overflowed thereby making it impossible to be stored.

What is claimed is:

1. A container for storing sulfite-containing photographic processing solutions, said container comprising
   a housing member for forming external walls of said container and
   a partition member disposed within said housing member, said partition member defining at least two chambers including a first chamber for containing said processing solution and a second chamber for collecting a waste solution, each chamber further comprising an opening portion;

wherein a portion of said housing member forming said first chamber comprises an oxygen shelter member for limiting the permeation of oxygen therethrough below 20 ml/m$^2$/24 hrs and wherein a wetting action of said waste solution upon a corresponding side of said partition member prevents oxygen from permeating the partition and oxidizing the processing solution in the first chamber.

2. The container of claim 1 wherein said second chamber is provided with a solution absorption expandable material.

3. The container of claim 1, wherein said housing member is a flexible housing member.

4. The container of claim 3, wherein said container comprises at least three sheets of flexible synthetic resin film, of which one sheet is used for said partition member and the two sheets are used for said housing member, and wherein one of the two sheets is used for said one part of said housing member which forms the first chamber and contacts with external air, and comprises said oxygen shelter member, and while the rest one of the two sheets is used for another part of said housing member foming the second chamber.

5. The container of claim 4, wherein said one part of said housing member, forming the first chamber, consists of at least two layers of which at least one layer except the most inner layer is said oxygen shelter member selected from the group consisting of ethylene vinyl alcohol, aluminum foil and aluminum-evaporated-deposited synthetic resin film.

6. The container of claim 5, wherein one surface of said partition member forms said first chamber and another surface forms said second chamber.

7. The container of claim 6, wherein said partition member comprises said oxygen shelter member.

8. The container of claim 7, wherein said partition member consists of at least two layers of which at least one layer except the layer having the surface forming said first chamber is said oxygen shelter member.

9. The container of claim 4, wherein said second chamber for collecting the waste solution comprises a solution-absorbing material therein.

10. The container of claim 9, wherein said second chamber is disposed on said first chamber.

11. The container of claim 10, wherein, when discharging the photographic processing solution from said first chamber and collecting the waste solution into said second chamber, said partition member is displaced in the direction to said first chamber in place of the discharged photographic processing solution and said solution-absorbing material absorbs the collected waste solution.

12. The container of claim 11, wherein said another part of said housing member, forming said second chamber, has two pieces of said opening of which the first opening is prepared for the first chamber and the second opening is prepared for the second chamber, and said partition member has an opening as the third opening, and wherein said first opening and said third opening are communicated with each other through a communicating means passing through inside of said second chamber.

13. The container of claim 12, wherein a section having said first opening on said another part of said housing member and a section having said third opening on said partition member are so superposed as to align both opening and are fitted with each other.

14. The container of claim 1, wherein said second chamber is disposed on said first chamber and has a solution absorbing material therein.

15. The container of claim 14, wherein said partition member can float on the photographic processing solution contained in said first chamber.

16. The container of claim 15, wherein, when discharging the photographic processing solution from said first chamber and collecting the waste solution into said second chamber, said partition member is lowered to said first chamber in place of the discharged photographic processing solution and said solution-absorbing material absorbs the collected waste solution.

17. A container for storing sulfite-containing photographic processing solutions, said container comprising a housing member for forming external walls of said container and a partition member disposed within said housing member, said partition member defining at least two chambers including a first chamber for containing said processing solution and a second chamber for collecting a waste solution, said first chamber further comprising a first opening portion, said second chamber further comprising a second opening portion, and a portion of said housing member forming said first chamber comprising an oxygen shelter member for limiting the permeation of oxygen therethrough below 20 ml/m$^2$/24 hrs, wherein said partition member is supplied with a third opening, said first opening and said third opening communicating with each other through a communicating means passing through the inside of said second chamber.

* * * * *